United States Patent [19]

Kitano et al.

[11] Patent Number: 4,533,257

[45] Date of Patent: Aug. 6, 1985

[54] ANALOG ELECTRIC TIMEPIECE

[75] Inventors: Masuo Kitano; Masahito Yoshino, both of Suwa, Japan

[73] Assignee: Kabushiki Kaisha Suwa Seikosha, Tokyo, Japan

[21] Appl. No.: 561,703

[22] Filed: Dec. 15, 1983

[30] Foreign Application Priority Data

Dec. 16, 1982 [JP] Japan ..... 57-220826
Sep. 28, 1983 [JP] Japan ..... 58-179839

[51] Int. Cl.[3] ..... G04B 17/20
[52] U.S. Cl. ..... 368/202; 368/157; 368/160
[58] Field of Search ..... 368/202, 157, 160; 318/696

[56] References Cited

U.S. PATENT DOCUMENTS 4,321,519 3/1982 Ueda et al. ..... 368/10
4,321,520 3/1982 Ueda et al. ..... 368/11
4,321,521 3/1982 Ueda et al. ..... 368/11
4,352,172 9/1982 Ueda et al. ..... 368/76

FOREIGN PATENT DOCUMENTS 2026216A 1/1980 United Kingdom .

*Primary Examiner*—Bernard Roskoski
*Attorney, Agent, or Firm*—Blum Kaplan Friedman Silberman & Beran

[57] ABSTRACT

Circuits are provided for avoiding misdetection of a non-rotated condition after driving the timepiece stepping motor. Voltages induced in the rotor coil by external high frequency magnetic fields, and current produced in the coil by lower frequency AC magnetic fields are detected. When a high frequency or AC magnetic field of sufficient intensity to cause a false indication of motor rotation is detected, the motor is next driven with a pulse having greater width than the normal driving pulse so as to assure operation of the motor. A period is provided, before the normal driving pulse would be applied, to detect AC magnetic fields and a period preceding the period for detection of AC magnetic fields is provided for detection of high frequency magnetic fields. A comparator or inverter is used to determine whether the levels of external magnetic fields are sufficient to cause misdetection of rotor position.

12 Claims, 40 Drawing Figures

FIG. 1(A)
PRIOR ART
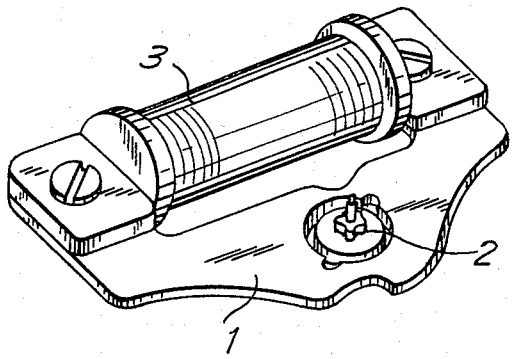
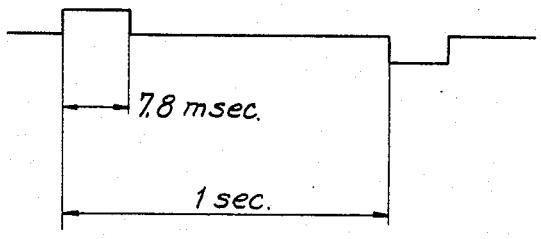
FIG. 1(B)
PRIOR ART

FIG. 2
PRIOR ART
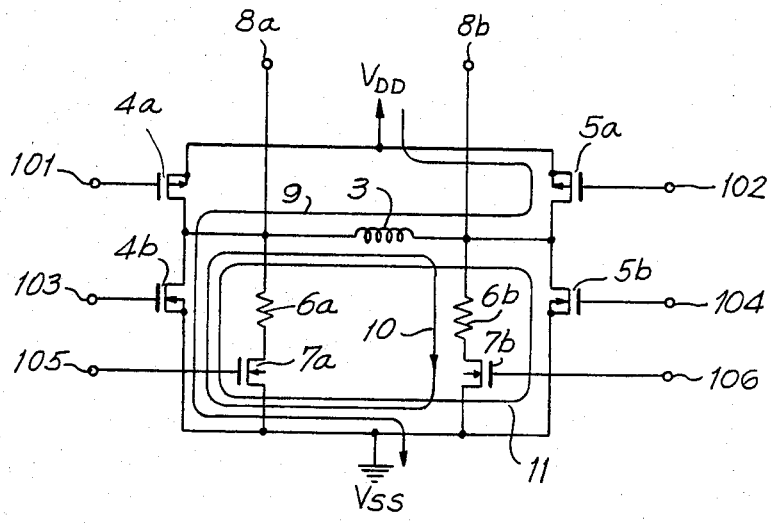
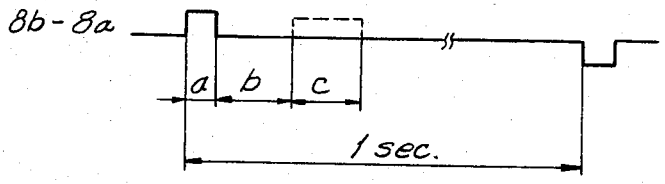
FIG. 3
PRIOR ART

FIG. 4
PRIOR ART
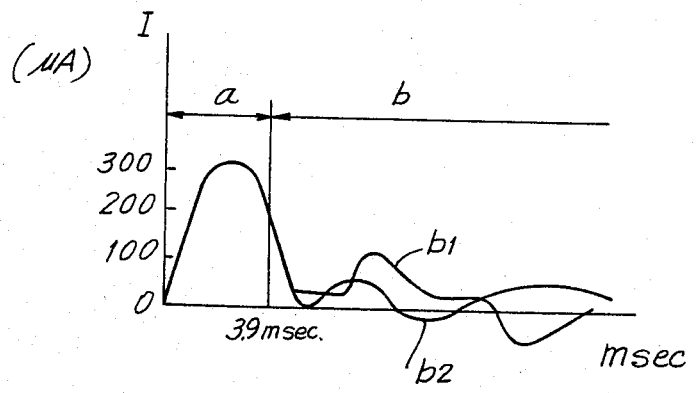
FIG. 5(A)
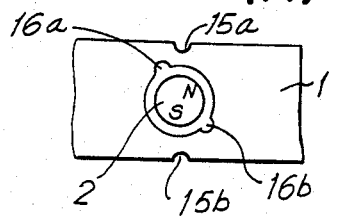
PRIOR ART
FIG. 5(B)
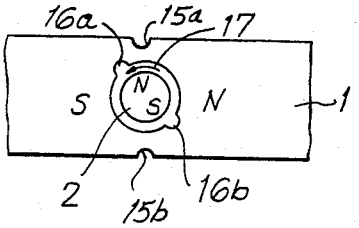
PRIOR ART
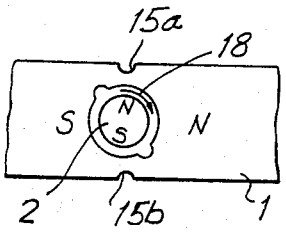
FIG. 5(C)
PRIOR ART
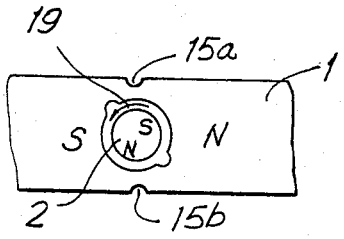
FIG. 5(D)
PRIOR ART FIG. 7
PRIOR ART
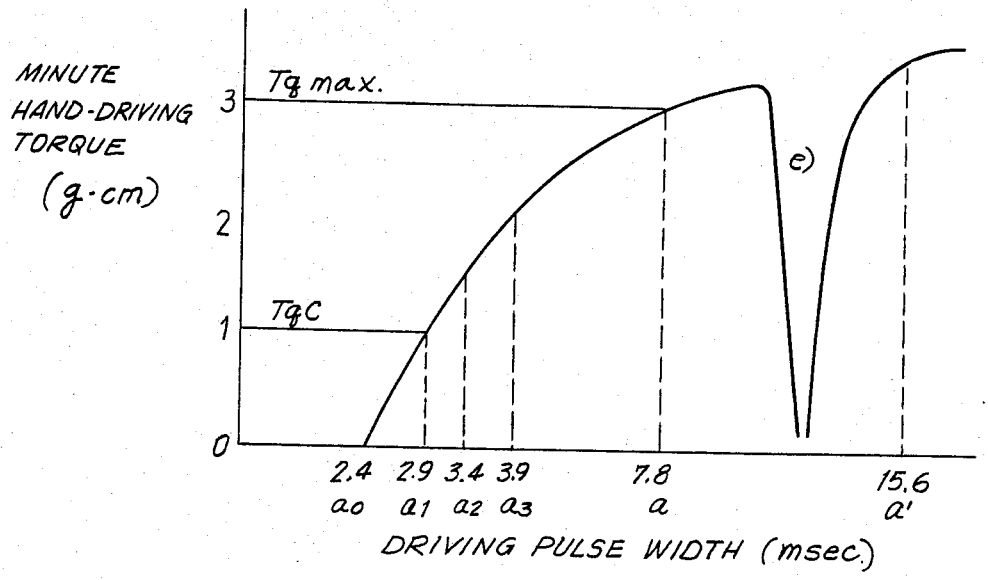
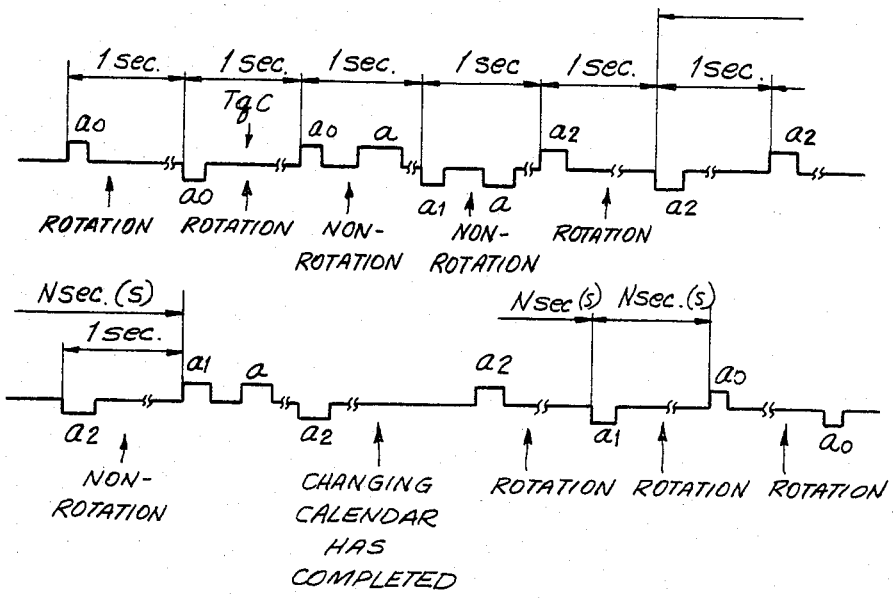
FIG. 8
PRIOR ART $\ell = -N \frac{d\phi}{dt}$

CHOPPED VOLTAGE WAVEFORM

PRODUCED VOLTAGE WAVEFORM

DETECTION VOLTAGE WAVEFORM

ANALOG ELECTRIC TIMEPIECE

BACKGROUND OF THE INVENTION

This invention relates generally to an analog electric timepiece and more particularly to an electric timepiece driven by a stepping motor having low power consumption and provided with a control circuit for preventing failure to accurately detect whether the stepping motor has rotated or not when driven. To improve the efficiency of electromechanical conversion in a stepping motor of low power consumption, such as an ultraminiature stepping motor for an electric wristwatch, a so-called correction drive method has previously been proposed. The correcting drive method is such that the rotor of the stepping motor is usually driven by a drive signal consisting of normal pulses of relatively narrow pulse width. However, if the rotor is not rotated by a complete step using the pulse of narrow width, for some reason or another, a correcting pulse of greater pulse width is applied. The most critical step in the correcting drive method is correct detection of a non-rotated condition of the rotor.

Various circuits have been devised to detect whether the rotor has in fact rotated when driven. When the rotor does not rotate a compensating pulse of sufficient pulse width is applied to assure that the rotor rotates and timekeeping does not lag. However, prior art circuits for detecting the rotated or non-rotated condition of the rotor have serious defects when the stepping motor is in an AC external magnetic field of low frequency such as 50 Hz or 60 HZ, or where there are high frequency fields such as occur, for example, when appliances such as electric blankets switch on and off. These high frequency and more conventional AC fields can affect the rotor windings and cause misreadings in the rotation detection circuit such that an indication of rotation is provided when in fact no rotation has occurred. In such a situation, the detection circuit will fail to provide the added pulse of greater pulse width which is necessary to keep the timepiece accurate.

What is needed is a stepping motor which advances accurately using driving pulses of narrow width for normal operation and longer pulses during heavy load operation. The stepping motor should operate reliably in the presence of AC magnetic fields and high frequency magnetic fields.

SUMMARY OF THE INVENTION

Generally speaking, in accordance with the invention, circuits for avoiding misdetection of the rotated or the non-rotated condition after driving of a stepping motor rotor are provided. Before the stepping motor is normally driven, the circuits detect voltages induced in the rotor coil by external high frequency magnetic fields, and current produced in the coil by lower frequency AC magnetic fields. When a high frequency magnetic field of sufficient intensity to cause a false indication of motor rotation is detected, the motor is next driven with a pulse having greater width than the normal driving pulse so as to assure operation of the motor. When an AC magnetic field is detected of sufficient magnitude to cause an error in determining the rotated or non-rotated status of the rotor, the subsequent driving pulse to the motor is greater than the normal driving pulse to assure rotation of the motor. A period is provided before the normal driving pulse to detect AC magnetic fields and a period preceding the period for detection of AC magnetic fields is provided for detection of high frequency magnetic fields. A comparator or an inverter is used to determine whether the levels of the external magnetic fields are sufficient to cause misdetection of the rotors position. Chopping is used in detecting currents induced by the AC magnetic field so as to amplify the effect for more reliable detection. Detection of rotor position is blocked when the rotor is driven following detection of a magnetic field capable of causing misdetection.

Accordingly, it is an object of this invention to provide an analog electric timepiece having circuits to detect AC magnetic fields and high frequency magnetic fields which can disturb operation of circuits for detecting the normal rotation or non-rotation of the rotor.

Another object of this invention is to provide an improved analog electric timepiece which operates with narrow pulse width when loads are low and external magnetic fields of significant magnitude are absent.

Yet another object of this invention is to provide an improved analog timepiece which drives the stepping motor with a wide pulse when external magnetic fields are present exceeding levels which cause misdetection of rotor position.

Still other objects and advantages of the invention will in part be obvious and will in part be apparent from the specification.

The invention accordingly comprises the features of construction, combination of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which:

FIG. 1(A) is a perpsective view of a stepping motor used in a conventional electronic timepiece and in an electronic timepiece in accordance with the invention;

FIG. 1(B) is a time chart showing driving pulses for driving the stepping motor of an electronic timepiece;

FIG. 2 is a partial circuit diagram of a driver circuit and a detector circuit used in a conventional electronic timepiece as well as in an electronic timepiece according to the present invention;

FIG. 3 is a time chart showing pulses for driving the stepping motor of a prior art stepping motor by a correcting drive method;

FIG. 4 is a graph of waveforms of current flowing upon and after the application of driving pulses to a stepping motor;

FIG. 5(A) illustrates diagrammatically the rotor and stator portions of a motor wherein the rotor is in rest position;

FIG. 5(B) indicates rotation direction of the rotor upon application of a normal driving pulse;

FIG. 5(C) illustrates rotor movement if the rotor does not correctly perform its revolution.

FIG. 5(D) illustrates movement of the rotor after a driving pulse has caused the rotor to perform its revolution completely;

FIG. 7 illustrates driving pulse width against output torque;

FIG. 8 illustrates the waveform of a correction driving pulse which changes pulse width in accordance with the load imposed on the motor;

DESCRIPTION OF THE PREFERRED EMBODIMENTS

Figure 6A:
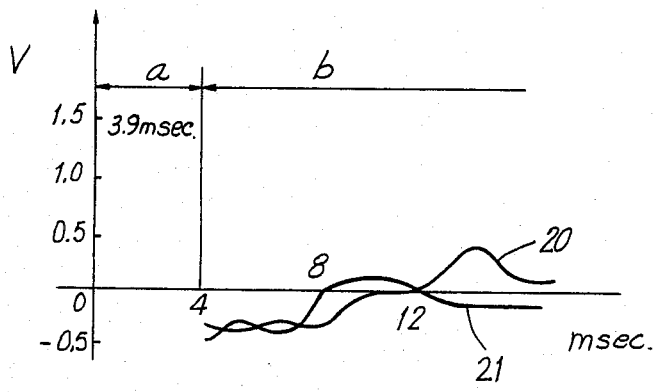
FIG.6(A) PRIOR ART
FIG. 6(A) illustrates two induced voltage waveforms produced across a detection resistance.

This invention relates generally to an analog electronic timepiece and more particularly to an electric stepping motor driven electronic timepiece comprising a stepping motor having low power consumption and provided with a control circuit. The control circuit prevents failure to accurately detect whether the stepping motor is in a rotated or non-rotated condition.

To improve the efficiency of electro-mechanical conversion in a stepping motor of low power consumption, such as an ultra-miniature stepping motor for an electric wristwatch, a so-called "correcting drive method" has previously been proposed. The correcting drive method is such that the rotor of the stepping motor is usually driven by a drive signal consisting of normal pulses of relatively narrow pulse width. However, if the rotor is not rotated by a complete step by a normal pulse of the drive signal for some reason or another, a correcting pulse with a pulse width which is greater than the pulse width of the normal pulse is applied. The most important step in the correcting drive method is correct detection of a non-rotation condition of the rotor.

This invention is illustrated in and explained with the aid of the drawings, in which:

FIG. 1(A) is a perspective view of a conventional two-phase stepping motor as often used for driving the hands of a known electronic analog timepiece and which can be used equally well for driving the hands of a timepiece in accordance with this invention.

FIG. 1(B) is a waveform of a drive signal conventionally applied to the stepping motor of FIG. 1(A). The drive signals of FIG. 1(B) are conventionally applied to a coil 3 of the stepping motor and a stator 1 is magnetized with the result that the rotor 2 rotates through 180° C. by repulsion and attraction between the magnetic poles induced in the stator 1 and permanent magnetic poles of the rotor for each pulse of the drive signal which consists of alternate pulses of opposite polarity. Conventionally, the width of each pulse of the drive signal is such as to ensure that the rotor will rotate under all conditions. Thus the pulse width must be sufficiently wide to rotate the rotor when a calender mechanism is driven by the stepping motor, when internal resistance of a battery increases when there is a reduction in drive voltage, when the battery nears the ends of its useful life, etc. Having the pulse width sufficiently wide to rotate the rotor motor under all conditions has the disadvantage that the power consumption is unnecessarily high when the load on the rotor is relatively low.

To overcome this disadvantage it has earlier been suggested that the stepping motor is usually driven by normal pulses having a minimum pulse width but when a detecting circuit detects that a normal pulse is insufficient to cause the rotor to rotate by a complete step, a correction pulse having a wider pulse width than a conventional normal driving pulse, is applied.

Although the detection of rotor movement could be effected by means utilizing an element, such as a mechanical switch or semiconductor device, external to the motor, such a use is inconsistent with satisfaction of the practical requirements in a timepiece-especially in a wristwatch as regards small size, thinness and low manufacturing cost.

To overcome the above-mentioned problem, one method of rotor movement detection is adopted, which utilizes the fact that the voltage induced in the coil by rotor movement after a driving pulse has been applied will be quite different if a non-rotation condition exists from what it is if a rotation condition exists.

An object of this invention is to improve the correcting drive method.

FIG. 2. is a circuit diagram of a stepping motor driver circuit and a detector circuit, which is used in both a conventional electronic timepiece and the electronic timepiece of this invention. The driver detector circuit includes gates of N-channel FET (hereinafter referred to as N-gate) 4b,5b, gates of P-channel FET (hereinafter referred to as P-gate) 4a,5a (wherein all gates are operated separately), detection resistances 6a,6b for detecting a non-rotation condition of the rotor 2, and N-gates 7a,7b for switching the detection resistances 6a, 6b respectively.

FIG. 3 shows a timing chart of a driving signal in the correcting drive method. During the time interval a shown in FIG. 3, in which the driving pulses are applied to the coil 3, the voltage produced across the coil 3 causes electrical current to flow along a current path 9 indicated in FIG. 2. Successively in the detection interval b in FIG. 3, the electrical current flows through the loop 10 including the detection resistance 6b in the direction indicated in FIG. 2. The voltage produced by the oscillation movement of the rotor 2 after driving pulses have been applied appears at terminal 8b.

If a non-rotation condition of the rotor is detected during the detection time interval b, the control circuit supplies correction pulses which are wide enough to rotate the rotor, when current flows along the current path 9 including coil 3 as indicated in FIG. 2.

The principle employed for detecting whether or not the rotor is in a rotation condition is now described.

FIG. 4 is a diagram showing the waveforms of current flowing upon an application of driving pulses through a motor coil 3 which has a 10,000 turns and a resistance of 3 k. During the time interval a, while pulses of 3.9 msec width are supplied to the motor, the current waveform exhibits the same curve as that shown in FIG. 4 regardless of the rotation condition of the rotor.

In the time interval b of FIG. 4, the curve shows the waveform of induced current which is caused to flow by oscillatory movement of the rotor after the driving pulse has been applied to the rotor.

The produced current waveform during the time interval b depends upon and greatly changes in in accordance with the load condition and the rotation condition of the rotor 2. The curve b1 of FIG. 4 shows the varying current produced if rotor 2 is in a rotation condition upon the application of drive pulses to the motor. The curve b2 of FIG. 4 shows the varying current produced if rotor 2 is in a non-rotation condition upon application of drive pulses.

Driver-detector circuit of FIG. 2 is constructed to sense the current values, which vary according to the rotation condition of the rotor, as a voltage waveform across coil 3, whereby whether or not the rotor is in a rotation condition is detected. The operation of this circuit is as follows. The current path 9 of FIG. 2 is changed over to the loop 10 including a detection resistance 6b during the time interval b of FIG. 4, which is a state in which the current induced by rotor oscillation movement of the rotor 2 flows through the detection resistance 6b, whereby a voltage of large undulated waveform develops at terminal 8b in comparison with the case when current does not flow through a detection resistance. Negative voltage develops at terminal 8b during the time interval b of FIG. 4 because the positive direction of the current flow is reversed at detection resistance 6b in loop 10.

When N-gate 5b is in an OFF condition, the P-N junction between the drain and the P− well of the N-gate 5b acts as a diode wherein terminal Vss acts as an anode. Therefore, the negative voltage developing at terminal 8b causes current to flow via the N-gate 5b acting as a diode. Here, N-gate 5b has the same impedance component as in the closed loop 11, which is braking the rotor. The relationship between operation of the rotor 2 and the detection signal is now described with the aid of FIG. 5.

FIG. 5 shows diagrammatically the rotor 2 and part of the stator 1 of a motor wherein a one-piece stator is utilized. The part of stator 1 of the motor shown in FIG. 5 has inner notches 16a and 16b for determining the index torque and outward notches 15a and 15b surrounding the rotor. In a case where a two-pieces stator is included in the stepping motor, the two notches 15a and 15b are separated.

FIG. 5(A) shows the rotor 2 in its rest position, in which a line passing through the poles of the rotor extends substantially at a right angle to a line passing through the inner notches 16a, 16b. FIG. 5(B) shows the state in which drive pulses are applied to the coil 3, with which the rotor 2 rotates in the direction of the arrow of FIG. 5(B). Here, the drive pulses have such a narrow pulse width, as 3.9 msec, that they cease before the rotor has rotated beyond the line passing through the notches 16a,16b. If the load imposed on the motor is so small as to be overcome by the drive pulse, rotor movement continues by reason of its inertia. Conversely, if the load is too large in relation to the driving pulse, the rotor fails to correctly perform its half revolution and returns by reverse rotation in the direction as indicated by the arrow 18 of FIG. 5(C). During the reverse revolution, a large current flows through the coil 3 because two magnetic poles S N of the rotor pass through in the vicinity of the outward notches 15a,15b. At that time, the rotor is subject to a braking action because a negative voltage developing at terminal 8b in the loop 10 of FIG. 2 causes forward current to flow through the N-gate 5b acting as a diode as is discussed in the above description. As the oscillation movement of the rotor is rapidly damped the voltage produced by the oscillatory movement of the rotor 2 becomes smaller.

Conversely, if the load is so small as to be overcome by the drive pulses, the rotor 2 rotates in a direction as indicated by the arrow 19 of FIG. 5(D). Initially produced current is small because the magnetic flux of the rotor is at a right angle to the line between outer notches 15a,15b. Successively, a large current flows when the magnetic poles N S rotate in the vicinity of the outer notches 15a,15b. At that time, a negative voltage appearing at terminal 8b included in the loop 10 causes the diode effect at N-gate 5b, so that the rotor is subjected to a braking action. After that, an excessively rotated rotor 2, wherein the rotor has rotated beyond its rest position of FIG. 5(A), returns by reverse revolution to its rest position. At the time a voltage develops at the terminal 8b of FIG. 2, with which determination is made whether or not the rotor 2 is in a rotation condition.

FIG. 6(A) shows a waveform 20 of voltage appearing at the terminal 8b if the rotor is in a rotation condition. During the time interval of a FIG. 6(A), the drive pulse of 3.9 msec width is fed to the stepping motor. At the time, the current flows along the current path 9 of FIG. 2, when VDD is 1.57 V. The curve during the time interval b of FIG. 6(A) shows the waveform of voltage produced by the oscillatory movement of the rotor which occurs when the current flows along the loop 10 of FIG. 2. Referred to the voltage waveform 20 of FIG. 6(A), the negative voltage is clamped at −0.5 V because of the effect of the N-gate 5*b* acting as a diode in the loop 10. The peak value of positive voltage reaches 0.4 V.

On the other hand, referring to voltage waveform 21 of FIG. 6(A), which shows the waveform of voltage produced if the rotor is in a non-rotation condition, after being pulsed in the period a, the peak value of positive voltage does not reach over 0.1 V. Thus, determination of whether or not the rotor is in a rotation condition is performed by comparing the peak values of voltage waveforms 20,21 of FIG. 6(A).

The difference of the peak values of positive voltage between the waveforms 20,21 is too small for convenient and reliable detection. Accordingly, amplification of the signals is adopted as will now be explained. Loops 10 and 11 of FIG. 2 are alternately changed over during the time interval b of FIG. 6(A). A large current flow is produced by the oscillatory movement of the rotor in loop 11 in which both ends of coil 3, that is N-gates 4*b* and 5*b* having ON-resistance of about 100Ω respectively, are short-circuited. The current produced by the oscillatory movement of the rotor flows through the detection resistance 6*b* at the instant the loop 11 is replaced in circuit by loop 10. At the time, because the inductance of motor coil 3 included in the loop 10 acts to keep the current flowing, a high value of peak voltage is developed across the detection resistance 6*b*.

Figure 6B:
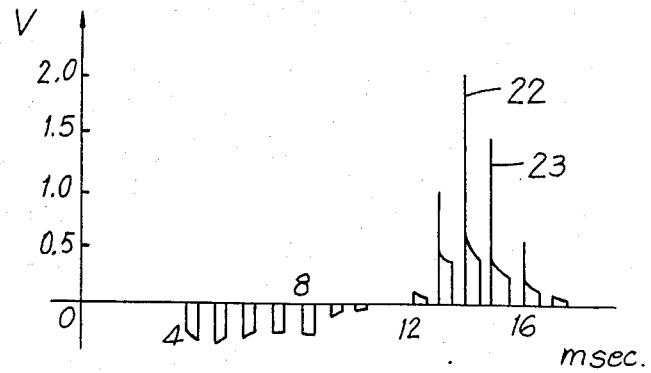
FIG.6(B) PRIOR ART
FIG. 6(B) illustrates the induced voltage waveforms produced across the detecting resistance when switching action is accomplished between a high resistance closed loop and a low resistance closed loop.
Figure 6C:
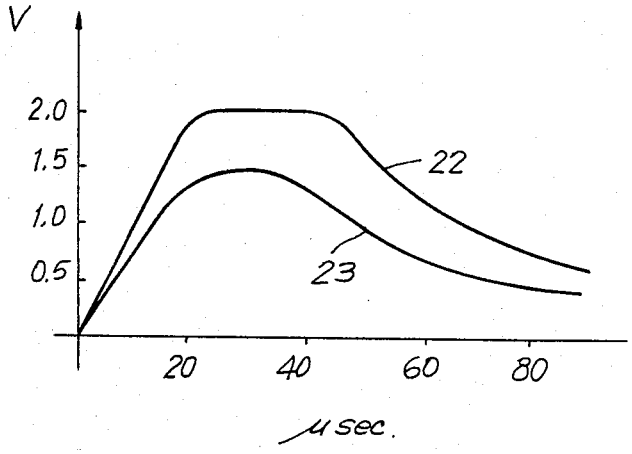
FIG.6(C) PRIOR ART
FIG. 6(C) illustrates magnfied waveforms of FIG. 6.

By the alternate switching action accomplished between the loops 10,11, voltage waveform 20 of FIG. 6(A), which shows the voltage produced if the rotor is in a rotated condition, is changed over to a waveform of FIG. 6(B). FIG. 6(C) shows the voltage-time voltage waveforms 22,23 of FIG. 6(B) when the time axis is magnified. Referred to FIG. 6(C), it takes 30μsec for the produced voltage to attain the peak voltage value after the current path is changed over to loop 10, which is effected by the capacitance components existing between the drain and source of N-gate 5*b*.

Whether the motor is in a condition of rotation or non-rotation is easily detected by the above-mentioned means of comparing produced voltages. Presently two systems are proposed for driving a stepping motor: one is to drive the stepping motor with stabilized normal drive pulses, and the other is to drive the stepping motor with normal drive pulses having the minimum pulse width required to rotate the rotor so that low power consumption is achieved.

FIG. 7 illustrates graphically the relationship of the output driving torque versus width of the drive pulse for driving the stepping motor for an analog electronic timepiece which has been in general use, and also for an analog electronic timepiece in accordance with this invention.

In the system in which the stepping motor is driven with a fixed stabilizing driving pulse, the width of the stabilized normal drive pulse is set at the point of FIG. 7 which is sufficient to assure the maximum torque, Tq max, for driving the stepping motor. While, in the correcting drive method, the width of a normal drive pulse is conventionally set at the point a1 of 2.9 msec width, or at a2 of 3.4 msec width. It is the premise that Tqc of FIG. 7 represents a calendar changing torque. That is, a margin is maintained in the driving pulse width for preventing an increase of overall power consumption which results from frequent supply of correction driving pulses to the motor in response to the detection of the non-rotation condition of the rotor upon application of the normal drive pulse. But, actually, the rotor can be in a rotated condition upon application of a normal drive pulses a0 of 2.4 msec width of FIG. 6(A) while no load is imposed on the stepping motor. Therefore, further economy in power consumption is achieved if the stepping motor is driven with a normal drive pulse of 2.4 msec width. Operation of the above-mentioned correcting drive method is now explained with the aid of FIG. 8.

In this method, drive pulses a0 of 2.4 msec width are used normally, i.e most of the time, but if the load increases so much above normal (e.g. during calendar changing) as to cause the non-rotation condition to occur, this is detected by a detection circuit and wider correction pulses, generally of 7.8 msec width, are applied. After one second, drive pulses a1 of 2.9 msec width, which is a little longer than that of a0 of 2.4 msec width, are automatically formed and fed to the motor. However, as shown in FIG. 8, (only as an example) the pulse width of drive pulse a1 is not sufficient for driving the stepping motor to overcome the calendar torque Tqc, so that the rotor comes into a non-rotated condition. In response to detection of the non-rotation condition of the rotor, the correcting pulse a of 7.8 msec width is immediately fed to the motor for setting up rotation of the rotor. After a further one second, the width of the normal drive pulse is automatically set at the point a2 of 3.4 msec width. The pulse width of a2 is large enough for driving the stepping motor to produce a larger torque than calendar torque Tqc. Then the stepping motor is continuously driven with normal driving pulse a2 of 3.4 msec width through successions of steps. This is illustrated in the upper waveform of FIG. 8. It should be understood that if a2 fails to rotate the rotor, a pulse a3 is next applied in the sequence.

However, continued driving of the stepping motor with the drive pulse a2 after calendar changing has been completed is against the object of this invention, that is to say, economy in power consumption. To eliminate the above-mentioned problem, a control circuit is provided which operates to reduce the width of the drive pulse after n seconds, that is, the normal drive pulses a2 of 3.4 msec width are, after n-steps, automatically replaced by normal drive pulse a1 of 2.9 msec width. If the stepping motor is rotated correctly through n-steps with pulses a1 of 2.9 msec width, the normal drive pulses a1 are thereafter replaced by the normal drive pulses a0 of 2.4 msec width.

Figure 9:
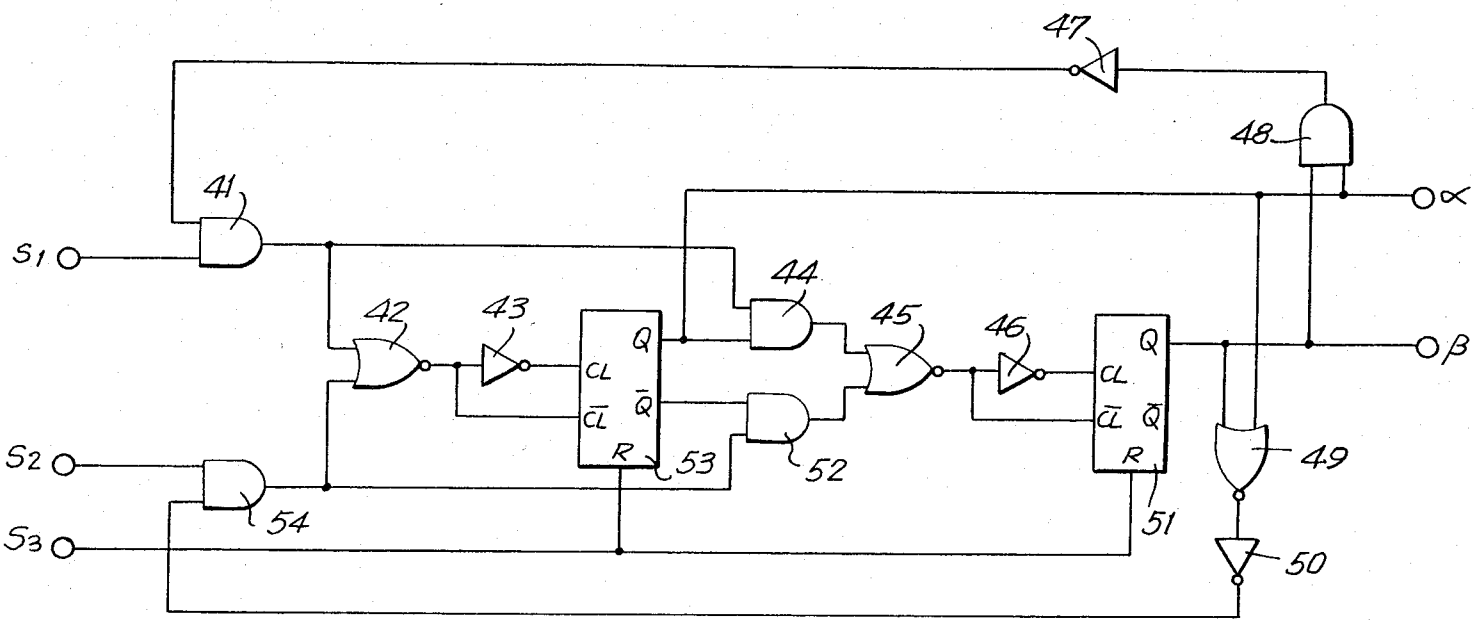
FIG. 9 is a circuit diagram of an up-down counter as employed for selecting a normal driving pulse.

If, the stepping motor becomes unrotatable upon applying the normal drive pulse a3 of the maximum pulse width, that is, 3.9 msec, a correction pulse a of 7.8 msec width is fed to the motor in response to detection of the non-rotation condition in order to make it rotate. Then, after one second, a normal drive pulse of 3.9 msec width is again fed to the motor. Here, an up-down counter of FIG. 9 operates to select the one normal driving pulse of appropriate width from a series of available correction pulses consisting of a plurality of different pulse widths.

As shown from the above description, the earlier constructions achieve economy in power consumption by utilizing the means for detecting whether or not the rotor is in a rotation condition and for driving the stepping motor with the normal driving pulses of minimum pulse width capable of maintaining rotation of the rotor.

Figure 10:
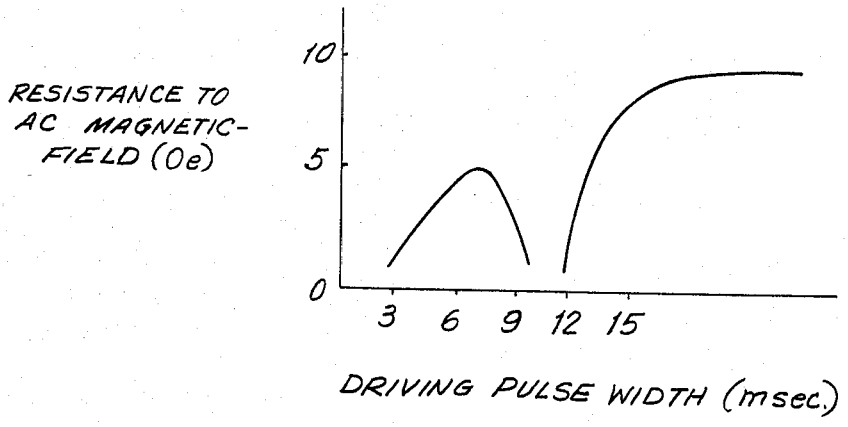
FIG. 10 is a graph of pulse width of a normal driving pulse versus anti-magnetic characteristics.

However, this system has serious defects, that is, when the stepping motor is in an AC external magnetic field, a voltage is induced across the coil 3 under the influence of the magnetic field. As a result of that, mis-detection of a non-rotated condition of the motor occurs, that is, the rotor 2 is determined to be in a rotated condition when it is actually in a non-rotated. condition. The resistance to an AC magnetic field of the stepping motor varies according to the width of the normal driving pulse fed to the stepping motor. FIG. 10 shows the relationship of pulse width and resistance to an AC magnetic field. In the case of FIG. 10, the stepping motor has an anti-magnetic field resistance of less than 3 oersted when it is driven with normal drive pulse of 3.9 msec width. Accordingly, a stepping motor is required to use a construction of more favorable resistance to a magnetic field when it is driven by the correcting drive method than a motor which is otherwise driven. Such a construction provided with sufficient resistance to a magnetic field requires more space and high cost than before. This does not meet the practical requirement for a timepiece, such as small size, thinness and low manufacturing cost.

In the system in which the stepping motor is driven with normal drive pulses of widths changeable according to the load imposed on the motor and lower power consumption is achieved, pulse widths of normal drive pulses are automatically adjusted to the minimum necessary to rotate the rotor when the calendar is not being changed and the motor load is light. This construction results in further deteriorated resistance to an AC magnetic field of the stepping motor as shown in FIG. 10. Therefore, in this case construction with stricter anti-magnetic characteristics is required for the stepping motor, for example, construction provided with a shielding board.

Figure 11:
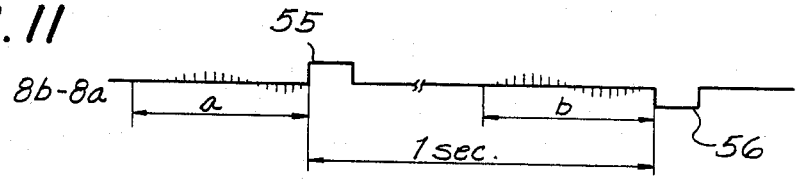
FIG. 11 is a timing chart of a normal driving pulse as commonly employed, in which the time intervals for detecting an AC magnetic field are illustrated.

The above-mentioned problem has been eliminated by proposing the following system, which will now be described with the aid of FIG. 11. During the time intervals a and b of FIG. 11, detection of an AC magnetic field is performed. Drive pulses of approximately 6 msec width are fed to the motor to cause rotation in response to detection of an AC magnetic field because the driving pulse of 6 msec width has a strong stability against AC magnetic field as shown in FIG. 10.

The method of detecting an AC magnetic field in this system is as follows; output transistors **4*b* and 5*b* of FIG. 2 are alternately switched ON with a predetermined frequency when the rotor is in its rest position during the periods before normal drive pulses 55, 56 are applied, which is the same operation as that performed in the detection of whether or not the rotor is in a rotated condition. Then, an AC magnetic field, if it exists, acts to produce a voltage across the coil 3, which causes current to flow through the coil 3. This produced current is increased by chopping, the value of which is sensed as voltage, so that a determination of whether or not an AC magnetic field exists is performed. Here, the peak value of AC magnetic field, which generally has a frequency of 50 Hz or 60 Hz, is detected in the following conditions generally; the detection period is 20 msec, output transistors 4*b* and 5*b*** are alternately switched ON with a frequency of 512 Hz, and duty ratio of the ON-state is 1/8.

Figure 12:
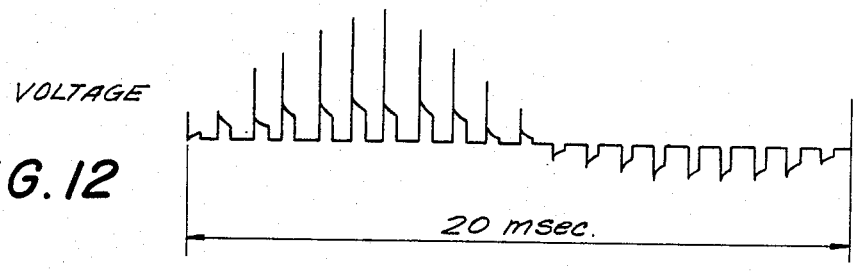
FIG. 12 is a detection voltage waveform during the detection time interval of an AC magnetic field.
Figure 13:
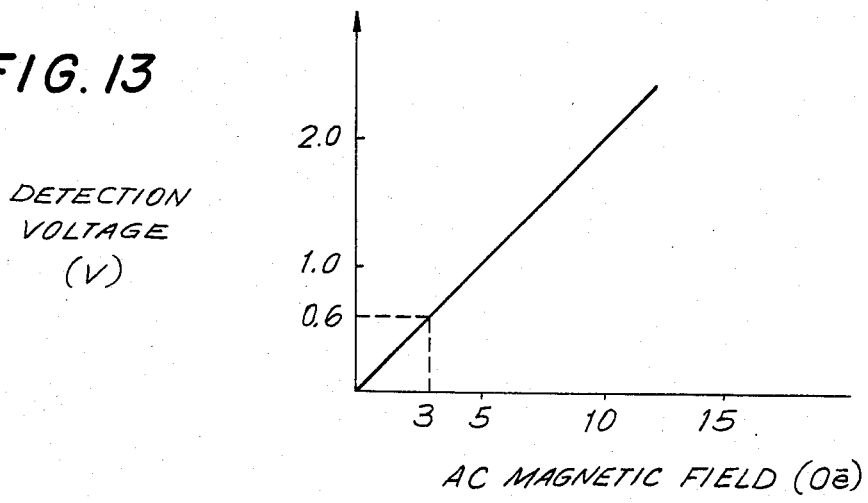
FIG. 13 illustrates the peak value of detection voltage during the detection time interval of an AC magnetic field.

In detection of a non-rotation condition of the rotor, when output transistor **4*b* or 5*b* is turned OFF, transistor 7*a* or 7*b* is respectively turned ON, thereby respective detection resistance 6*a* or 6*b* is electrically connected. While in the detection of AC magnetic field, neither transistor 7*a* nor 7*b* is turned ON so as to heighten the sensitivity of detection. FIG. 12 shows the voltage waveform which is produced by chopping as a general example. FIG. 13 shows a relationship of the strength of AC magnetic field (Oe) and detection voltage (V) as a general example. Conventionally, a comparator or gate terminal of an inverter is connected across the terminals 8*a* and 8*b* of FIG. 2** and threshold voltage is set at 0.6 V in order to detect an AC magnetic field of 3 oersted.

Figure 14A:
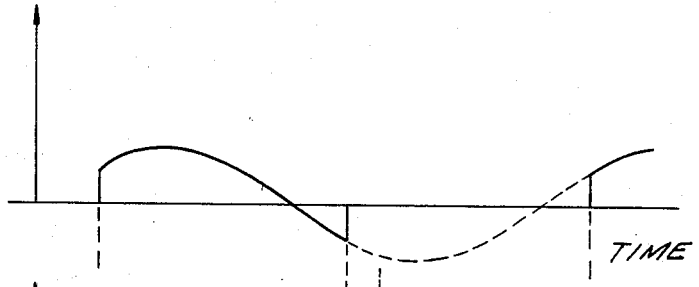
FIGS. 14A, 14B illustrates waveform of magnetic field produced by an electric blanket and the waveform of detection voltage thereof.
Figure 14B:
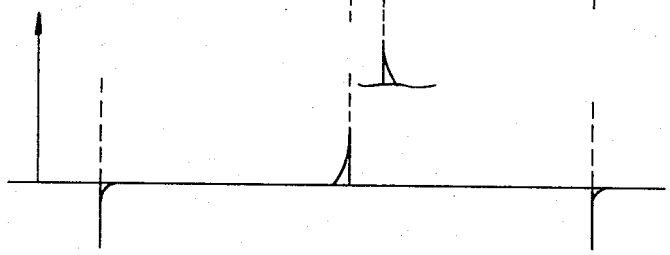

Here, detection is limited to the AC magnetic field of a sinusoidal wave of 50 Hz or 60 Hz frequency. However, there are actually various AC magnetic fields. For example, the magnetic field produced by an electric blanket as shown in FIG. 14. An electric blanket generally has an AC electrical current of sinusoidal waveform which is partially cut by a thyristor in order to control the effective current value. Because the electrical current flow causes a magnetic field in proportion to the value of the current, the magnetic field produced by the electrical blanket has a partially cut sinusoidal wave as shown by the upper part of FIG. 14. The magnetic field changes rapidly during the period when the sinusoidal wave is cut. The peak of the voltage induced across the coil of the stepping motor becomes high under the influence of the above-mentioned magnetic field, which is expressed by the following equation;

$$e=-N(d\phi/dt),$$

wherein e is the induced voltage, N is the number of turns of the coil 3, $\phi$ is magnetic flux and t is time. The above-mentioned magnetic flux, changing in such a short time as to have high frequency components, is defined hereinafter as a magnetic field of high frequency. On the other hand, the magnetic field of a sinusoidal wave of such a low frequency as 50 Hz or 60 Hz is defined hereinafter as AC magnetic field or magnetic field of low frequency.

It is observed from the equation and FIG. 14, that the induced voltage across the coil 3 produced by only the effect of magnetic field is possibly over the voltage which is used to indicate whether the rotor is in a rotation or a non-rotation condition during the detection time interval for ascertaining the rotation condition of the rotor. Then, a mis-detection of the rotation condition of the motor occurs, that is, the detection circuit determines that the rotor is in a rotation condition while actually it is in a non-rotation condition. Thus, no correction drive pulse is supplied to the motor. As a result, the hand is not driven, and display time lags behind the actual time. Also, in the case shown by FIG. 14, it is almost impossible to detect the AC magnetic field, although it exists, because the magnetic field changes for very short times during the detection intervals of AC magnetic field a and b of FIG. 11, so current flow caused by the voltage produced across the coil 3 is very little. When the output transistor **4*a* or 4*b* is in an OFF state, the produced voltage $e=N(d\phi/dt)$ develops without dropping, thus, an AC magnetic field can be detected. However, here, the duty ratio of OFF-state is 1/8, so that there is very little possibility of detecting an AC magnetic field. In detection of a non-rotated condition of the rotor, output transistor 4*a* or 4*b*** is turned off with a duty ratio of the OFF-state being ½, which results in a high possibility of misdetection.

As stated above, the prior art cannot detect such an AC magnetic field as has a square wave shape, for example, produced by an electric blanket as shown in FIG. 14 nor can the occurrence of misdetection of rotation condition of the rotor be prevented. Besides the above mentioned electric blanket, various electric apparatuses for personal use such as an electric carpet, electric foot warmer, electric heater and so on produce magnetic fields with square waves. Therefore, there is a high possibility that the stepping electric motor driving an electronic timepiece is under the influence of the above mentioned magnetic fields and the display time is lagging behind the actual time. This is a serious defect in a quartz crystal analog timepiece.

Figure 15:
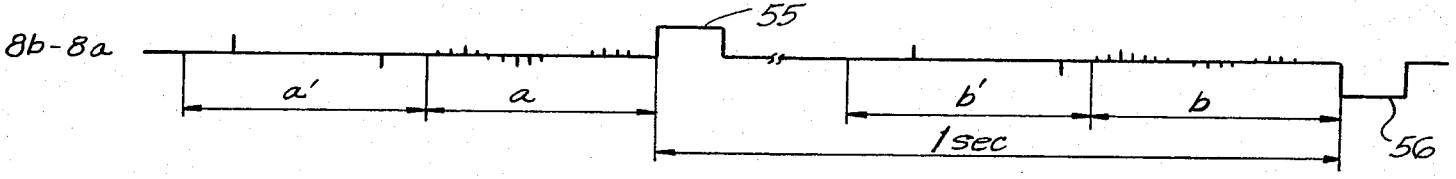
FIG. 15 is a timing chart of a normal driving pulse of this invention in which the time intervals for detecting AC magnetic field and for detecting magnetic field comprising high frequency are illustrated.

This invention eliminates the above mentioned defects by providing means for detecting magnetic fields comprising a high frequency in addition to the above mentioned means for detecting an AC magnetic field, which system is now described with the aid of FIG. 15.

FIG. 15 is a diagram showing the normal pulse waveform wherein the time intervals a and b are periods for detecting AC magnetic fields and the time intervals a' and b' are periods for detecting high frequency magnetic field. Here, if either the AC magnetic field or magnetic field comprising high frequency is detected, operation of detecting a non-rotated condition of the motor is prohibited and motor drive pulses of sufficient pulse width for driving the motor against the applied magnetic field are applied. In one case, motor drive pulses of 6 msec width are applied as shown in FIG. 10.

Figure 16:
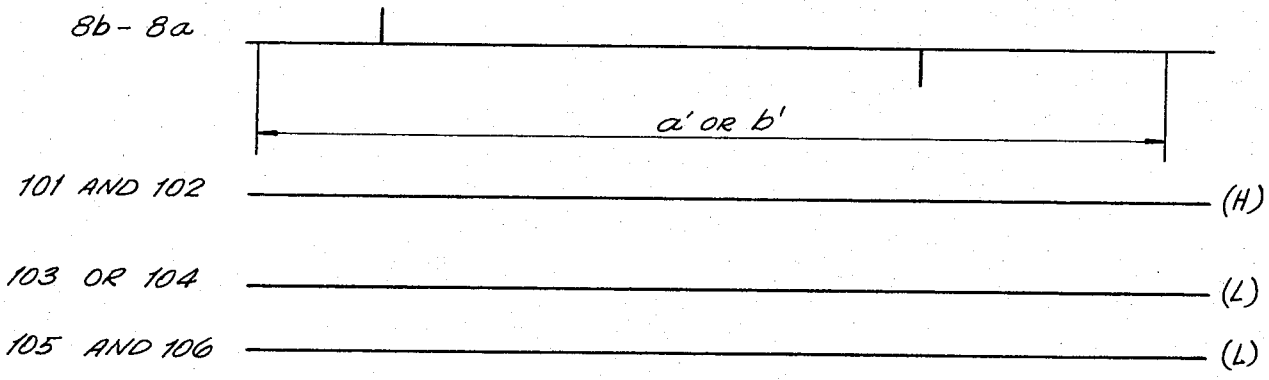
FIG. 16 is a timing chart showing the detection time intervals a' and b' of FIG. 15 for detecting magnetic field comprising high frequency.

FIG. 16 is a timing chart of pulse waveforms which shows a time interval for detecting magnetic field comprising high frequency. During these time intervals a',b', either output transistor 4*b* or 5*b* is continuously in the OFF state, so that, peak value of any produced voltage is detected during this time interval a',b'. The detection voltage waveform is similar to what is defined by the equation $$e=N(d\phi/dt)$$

in FIG. 14. Here, a detection period for a magnetic field comprising high frequency equal to or greater than 20 msec is required for detecting the peak value of the voltage produced under the influence of a magnetic field comprising high frequency, because a magnetic field comprising high frequency, which is produced from an apparatus for personal use driven by an AC source, basically has a repetition period of 16 msec or 20 msec. Mis-detection of the non-rotation condition of the motor, which is caused by the effect of a magnetic field comprising high frequency can be avoided by setting the voltage level for detecting a magnetic field comprising a high frequency lower than that for detecting a non-rotation condition of the rotor. The possibility of mis-detection of the non-rotation condition of the rotor is further reduced by dropping the level of the voltage appearing under the influence of a magnetic field comprising high frequency during the time interval for detecting the rotation condition of the motor by using a resistance 6*a* or 6*b*.

Figure 17:
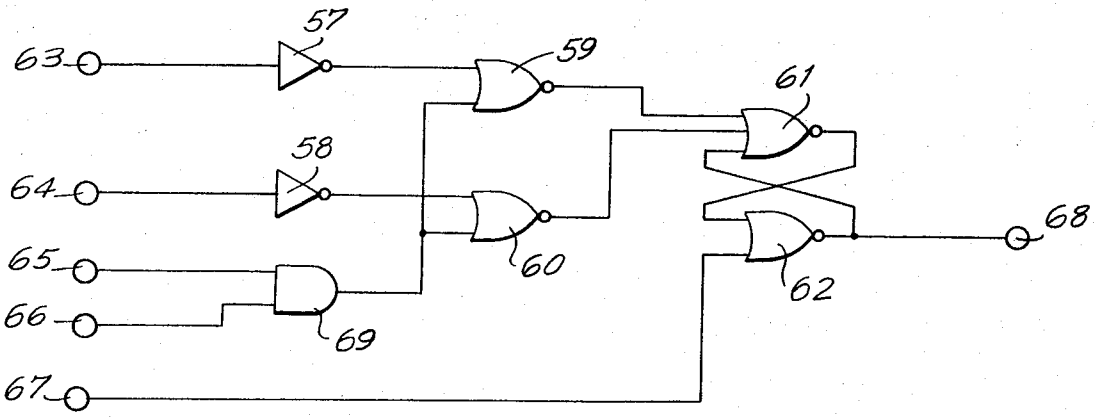
FIG. 17 is a circuit diagram of this invention which performs detections of magnetic field comprising high frequency and AC magnetic field.

Here, a pair of detection inverters or comparator used for the circuit operating to detect an AC magnetic field can also be used in the detection circuit for a magnetic field comprising high frequency. However, if another pair of detection inverters or comparator is used in the detection circuit for magnetic field comprising high frequency, stricter detection is achieved. FIG. 17 shows a circuit which operates to detect both an AC magnetic field and a magnetic field comprising high frequency by using one pair of detection inverters. Detection inverters 57,58 are respectively connected to terminals 8*a* and 8*b*. NOR-gates 59,60 mask detection signals. NOR-gates 61,62 comprise a latch circuit. Terminals 63,64 are connected to terminals 8*a*,8*b* for inputting the detection voltage. A masking signal 65 for detecting an AC magnetic field is LOW level only during the time interval for detecting an AC magnetic field. A masking signal 66 for detecting a magnetic field comprising high frequency is low level only during the detection interval. A terminal 67 provides for clearing the detection latch. Terminal 68 is for outputting a detection signal. AND gate 69 receives the signals 65,66.

Figure 18:
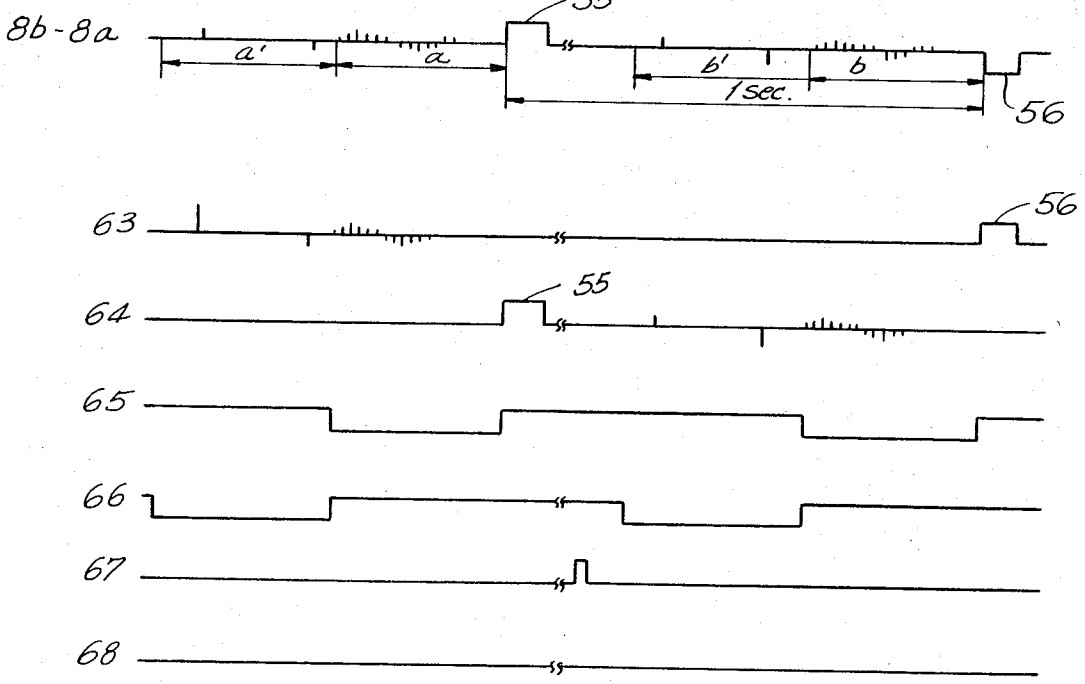
FIG. 18 represents timing charts showing the condition at each terminal of FIG. 17.

FIG. 18 represents timing charts, showing the signal conditions at each terminal of FIG. 17. It is observed from the condition of output at terminal 68, which is LOW, that no magnetic field is detected. The system shown in FIG. 17 wherein a pair of inverters are used for detecting magnetic fields has the same number of terminals as that of a conventional one and performs detection of two types of magnetic fields, that is to say, AC magnetic field and magnetic fields comprising high frequency. Here, the detection period for detecting the magnetic field comprising high frequency can be made longer than 20 msec as long as no influence thereof is exerted on the driving of the motor and the detection of the non-rotated condition of the rotor.

As stated above, the stepping motor of this invention can detect almost any dynamic magnetic field existing in environmental space for a human's daily life, so that, the reliability of hand advancement in the stepping motor driven electronic timepiece is highly developed. This invention does not cause such disadvantage as enlargement of chip size in an IC and the increase of inspection cost required during the manufacturing process thereof.

Another advantage of this invention is that the practical requirements in a timepiece such as smallness of size and thinness are satisfied by rendering unnecessary any anti-magnetic construction provided with anti-magnetic shielding panels and the like, which is indispensable to prior art constructions.

The function of the detecting circuit of this invention does not change even though N-channel transistor and P-channel transistor thereof are interchanged. In such a case each terminal is reversed (HIGH to LOW, LOW to HIGH). In this invention, driving pulses of the same pulse width are fed to the motor in response to the detection of magnetic field and to the detection of a sinusoidal AC magnetic field. However, the stepping motor can actually be driven with narrower pulses in response to detection of a magnetic field comprising higher frequency than in response to the detection of the AC magnetic field. Accordingly, further economy in power consumption is achieved when the motor is supplied with a narrower driving pulse in response to detection of magnetic field comprising higher frequency than in response to detection of an AC magnetic field.

In the above described system, it is appropriate to select the driving pulse, which is supplied to the motor in response to the detection of a magnetic field comprising high frequency, from a range of pulse widths described with the aid of FIG. 8 with a view to simplify the detector and driver circuit. Especially the driving pulse a3 of FIG. 3, which has the longest pulse width, or the driving pulse a2 of FIG. 8, which has a one step shorter pulse width than a3, is most appropriate because a magnetic field comprising a high frequency with square waves does not have so much energy as to exercise a great influence on driving of the motor in comparison with a sinusoidal AC magnetic field. That is, reliability of the driving of the time display of the timepiece is secured without applying pulses of so long a pulse width as 6 msec, as described above with the aid of FIG. 10 as being most stable against an AC magnetic field. Accordingly, power consumption of the stepping motor under the influence of a magnetic field comprising a high frequency is reduced, then further economy of overall power consumption is achieved.

In summary, if the magnetic field shown in FIG. 14 affects the coil 3 of the stepping motor during the operation of detecting the non-rotated condition of the rotor, the induced voltage across the coil 3, induced by only the effect of a magnetic field, is possibly over the voltage which is indicative of whether the rotor is in a rotated or a non-rotated condition during the detection time interval of the rotation condition of the rotor. Then, misdetection of a rotation condition of the motor occurs, that is, the detection circuit determines that the rotor is in a rotation condition while actually it is in a non-rotation condition. Thus, no correction drive pulse is supplied to the motor. As a result, the hand is not driven, and the display time lags behind the actual time.

Figure 19A:
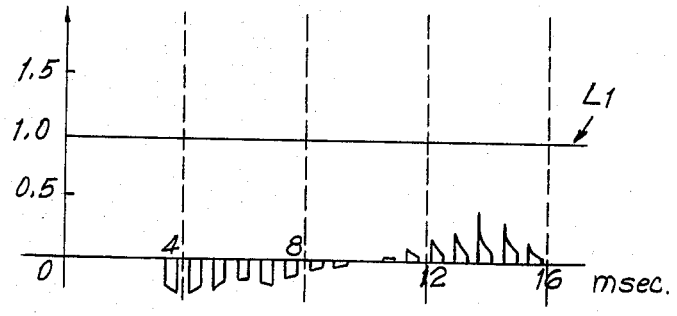
FIG 19*a,b,c* represents produced voltage waveforms, which shows the occurrence of mis-detection under the magnetic field comprising high frequency.
Figure 19B:
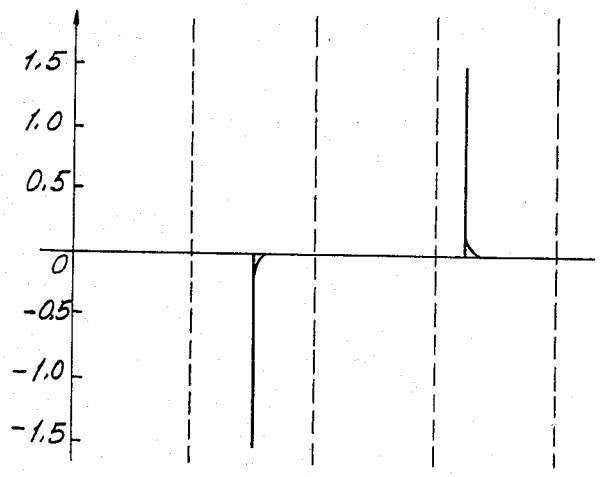
Figure 19C:
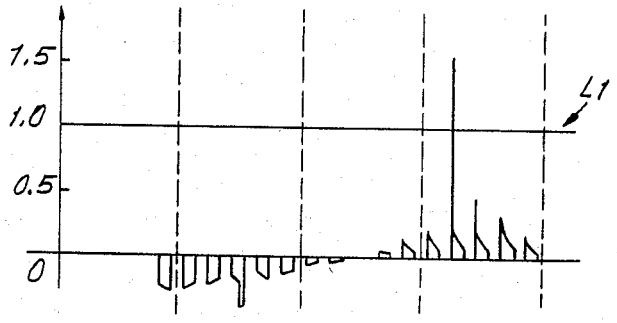

FIG. 19(*a*) represents the chopped voltage waveform which is induced if the rotor is in a non-rotated condition. FIG. 19(*b*) represents the voltage waveform induced under the influence of a magnetic field comprising high frequency. FIG. 19(*c*) represents the detection voltage waveform for detecting the non-rotated condition of the rotor wherein the appearing voltage is the overlap of the voltages shown in FIG. 19(*a*) with that shown in FIG. 19(*b*). L1 of FIG. 19(*a*) is the voltage level for detecting a non-rotated condition of the rotor. The chopped voltage induced if the rotor is in a non-rotated condition does not actually reach the level of L1 of FIG. 19(*a*). However, in case the voltage induced if the rotor is in a non-rotated condition overlaps with the voltage induced under the influence of a magnetic field comprising high frequency, the induced voltage for detecting the non-rotated condition of the rotor exceeds the L1 level. This is a false indication of rotation. The above described is how mis-detection of a non-rotated condition of the rotor occurs.

Now the description is given with respect to the detection of the above-mentioned magnetic field comprising high-frequency carried out during the detection time interval for AC magnetic field. As is known from the preceding description, the AC magnetic field is detected by the following method; the induced current which is caused to flow by the voltage induced due to the change of magnetic field is increased by chopping, that is, the switching ON and OFF of the circuit, through which the induced current flows, is repeated. Then the increased current is taken out as a detection voltage.

Figure 20A:
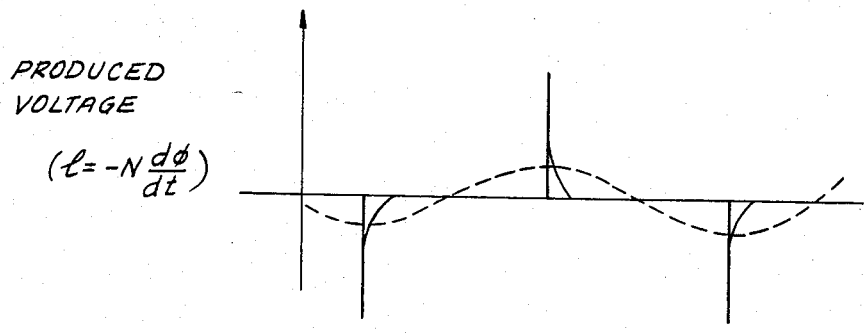
FIG. 20*a,b* represents waveforms of the produced voltages and currents under the influence of AC magnetic field or the magnetic field comprising high frequency.
Figure 20B:
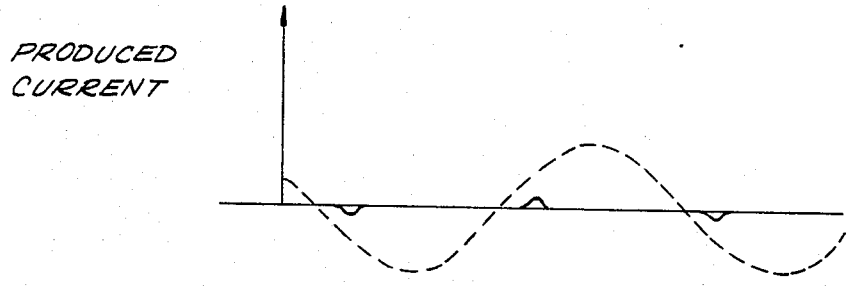

FIG.20(*a*) shows the two voltage waveforms. The solid line represents what is produced under the influence of a high frequency magnetic field and the broken line represents what is induced under the influence of a general AC magnetic field. FIG. 20(*b*) shows the two induced current waveforms. The solid line represents what is induced under the influence of a high frequency magnetic field and the broken line is what is induced under the influence of a general AC magnetic field.

Here, the induced voltage of FIG. 20(*a*) is determined at the coil of the stepping motor of which both ends are opened so that no current flows through the coil. The induced current of FIG. 20(*b*) is determined at the coil of the stepping motor of which both ends are short-circuited so that sufficient current flows through the coil. Under the influence of the magnetic field comprising high frequency, the induced voltage has a high peak value as shown in FIG. 20(*a*) because the magnetic field comprising high frequency varys sharply and the current caused to flow by the induced voltage is small as shown in FIG. 20(*b*) because the changing period of the magnetic field comprising high frequency is very short. Thus the period for the induced voltage to appear is very short.

On the other hand, under the influence of an AC magnetic field, the induced voltage has low peak value as shown by FIG. 20(*a*) because the AC magnetic field changes slowly and the current caused to flow by the induced voltage is comparatively large because the induced voltage has a sinusoidal wave having sufficient effective value.

It follows from the preceding explanation that the AC magnetic field is possibly detected from the chopped and increased current caused to flow under the influence of the AC magnetic field, howver, the magnetic field comprising high frequency is not detected because the current caused to flow under the influence of the magnetic field comprising high frequency is small.

As mentioned above, the earlier circuits cannot detect such an AC magnetic field as to have a square wave, for example, what is induced by an electric blanket shown in FIG. 14, nor can the occurrence of misdetection of the rotation condition of rotor be prevented. The magnetic field with a square wave is as previously stated, induced from, besides the above mentioned electric blanket, various electric apparatus for personal use such as electric carpet, electric foot warmer, electric heater and so on, which are controlled in current flow by a thyristor. Therefore, there is much possibility that the stepping electric motor driven electric timepiece is under the influence of the above mentioned magnetic field and that the display time is lagging behind the actual time.

This invention eliminates the above mentioned defects by providing the means for detecting high-frequency magnetic field in addition to the above mentioned means for detecting AC magnetic field, which system now is described in further detail.

Figure 21:
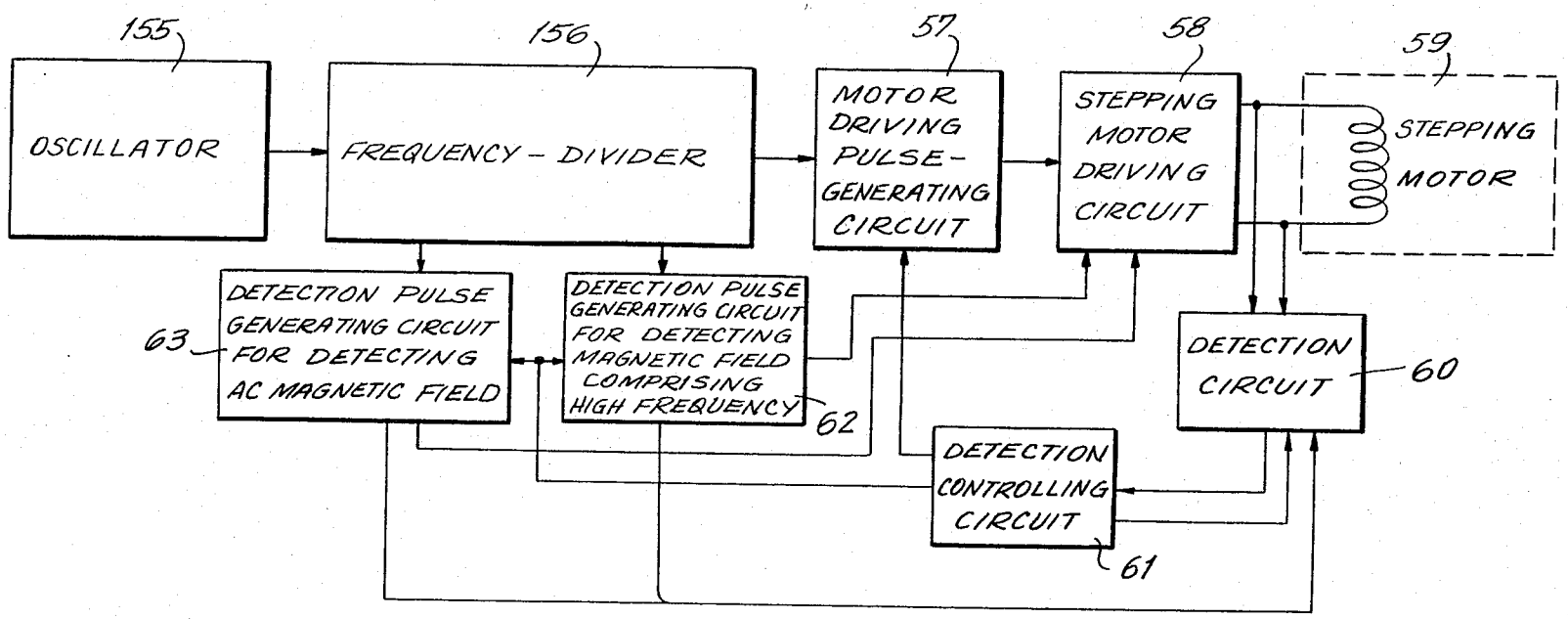
FIG. 21 is a circuit block diagram of this invention.

FIG. 21 represents the circuit block diagram of an embodiment of this invention. A time standard signal generated by an oscillator 155 is applied to a frequency-divider circuit 156. The signals passed through the frequency-divider circuit 156 are divided and supplied into each of three circuits, that is, a circuit 57 generating motor driving pulses, a circuit 63 generating detecting pulses for AC magnetic field, and the circuit 62 generating detecting pulses for a magnetic field comprising high frequency. The pulses generated by each of the three pulse generating circuits 57, 62,63 are all fed to a stepping motor driving circuits 58 to be synthesized. The detection of the non-rotation condition of the rotor, AC magnetic field and magnetic field comprising high-frequency are accomplished by the detection circuit 60, including a comparator or a pair of inverters by using the detection voltage induced across the coil of a stepping motor 59. The detection signals from the detection circuit 60 are applied to the detection controlling circuit 61, whereby the three pulse generating circuits 57, 63,62 are controlled.

As described above with the aid of FIG. 21, this invention provides means for detecting a magnetic field comprising high frequency from a conventional stepping driving circuit which includes means for detecting the non-rotation condition of the rotor. The oscillator 55, the frequency-divider circuit 56, the pulse generating circuit 56 for driving a stepping motor and the stepping motor driving circuit 58 as shown in FIG. 21 are commonly used, so are not explained here.

Figure 22:
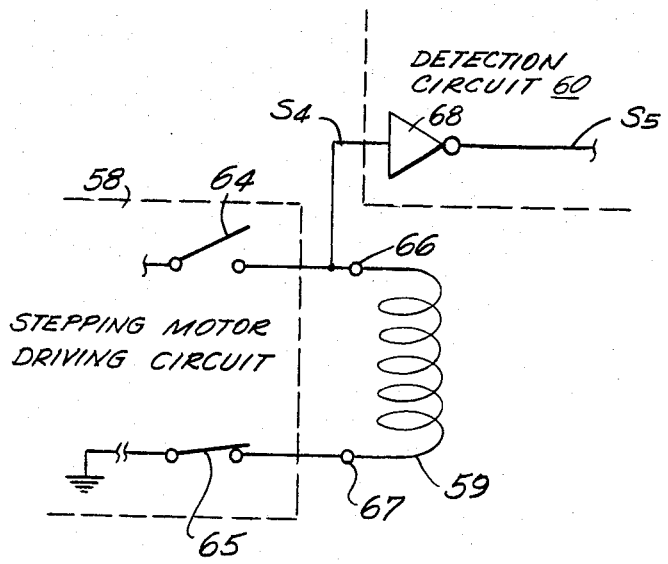
FIG. 22 is a simplified circuit diagram, which represents the principle of the detection of magnetic field comprising high frequency.

The principle of detecting the magnetic field comprising high frequency is now explained with the aid of FIG. 22. FIG. 22 is a simplified diagram of a circuit connected to a stepping motor, which refers to the principle on which the detection of magnetic field comprising high frequency is performed. A switch 64, which is open, indicates that a semiconductor element included in the stepping motor driving circuit 58 connected to the coil of the stepping motor at the terminal 66, has high impedance. At this time, sufficient detection voltage is induced from which reliable detection of a magnetic field comprising high frequency, if it exists, is accomplished. The switch 65, which is closed, indicates that ground and a semi-conductor element connected to the terminal 67 of the coil are short-circuited. The detection inverter 68 included in the detection circuit 60 determines whether or not the voltage level S4 at the coil terminal 66 exceeds the threshold voltage level of the detection inverter 68 and produces a detection output signal S5.

Figure 23A:
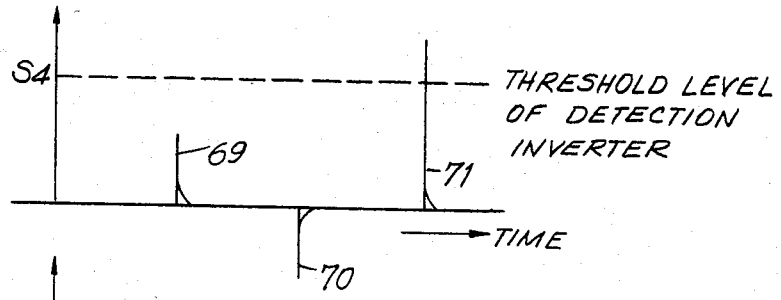
FIGS. 23*a,b* represents the detection characteristics of detection inverter 68 of FIG. 22.
Figure 23B:
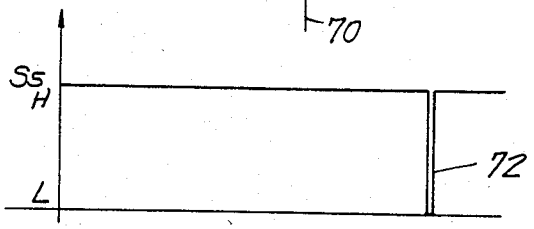

FIG. 23 represents the detection characteristics of the detection inverter 68. S4 of FIG. 23(*a*) represents the voltage level at terminal 66 of the coil, which is induced under the influence of a magnetic field comprising high frequency. FIG. 23(*b*) represents the waveform of the output signal S5 induced from the detection inverter 68, which is logic level "H" or "L". In FIG. 23(*a*) peak values 69,70,71 of voltage are produced, out of which, only peak 71 exceeds the threshold voltage of the detection inverter 68.

When the induced voltage exceeds the threshold voltage of the detection inverter 68, output signal S5 produced from the detection inverter 68 becomes logic level "L" as shown at 72 of FIG. 23(*b*). The signal S5 produced by the detection circuit is inputted into a latch circuit. The above description is the principle on which the detection of the magnetic field comprising high frequency is performed. Incidentally, during the time interval for detecting AC magnetic field, opening and closing operation of switch 64 is repeated.

Figure 24:
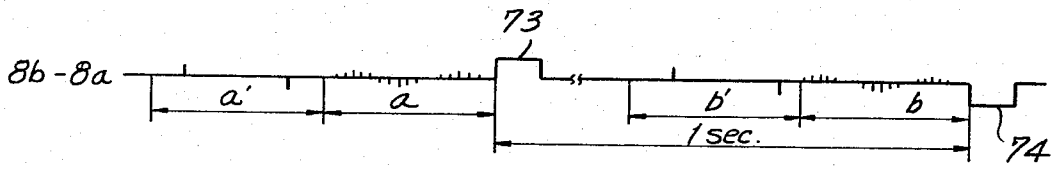
FIG. 24 is a timing chart of normal stepping motor driving pulses of this invention.
Figure 25:
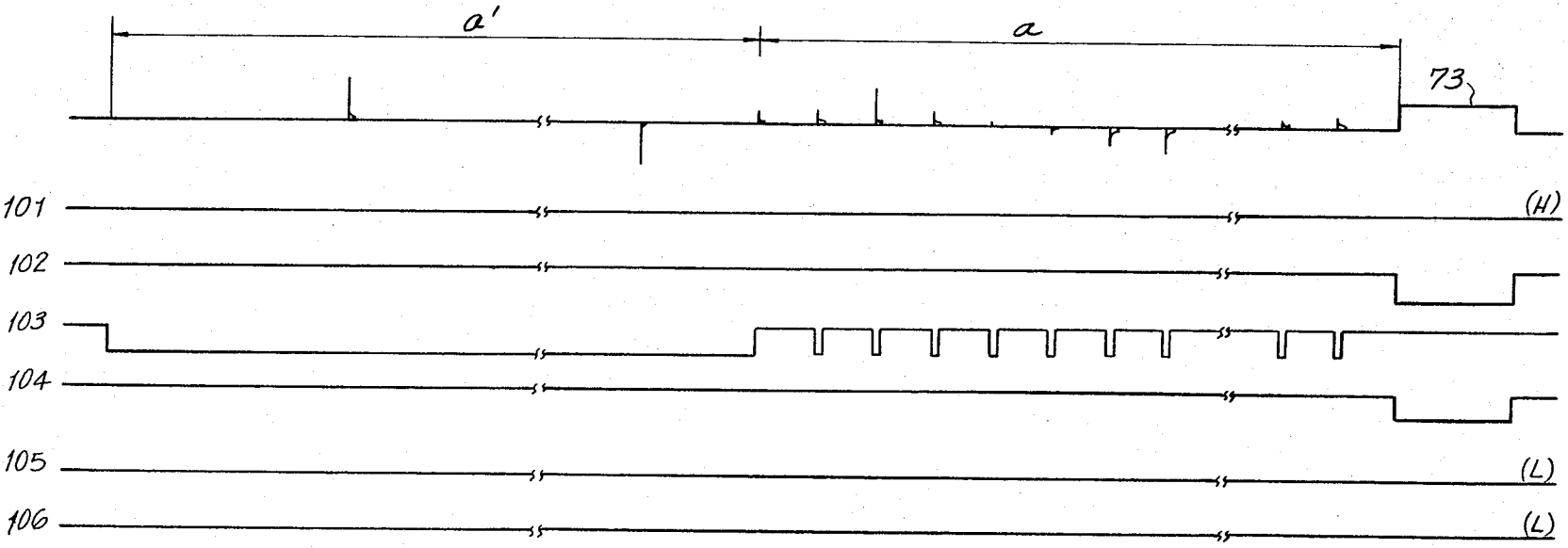
FIG. 25 is timing charts, which represent the operation for the detection of magnetic field.

The actual circuit operation carried out on the principle of the detection of a magnetic field comprising high frequency as shown in FIG. 22 will now be described. Here, the conventional stepping motor driving circuit shown in FIG. 2 is also used for this invention so that this invention will be now described with the aid of FIGS. 2, 24 and 25. FIG. 24 (Similar to FIG. 15) is a timing chart of a normal driving pulse of this invention. 8*b*–8*a* of FIG. 25 represents the difference in potential between the terminals 8*a* and 8*b* of FIG. 2. In FIG. 24, a′ and b′ represent the time intervals for detecting a magnetic field comprising high frequency. In FIG. 24, a and b represent the time intervals for detecting AC magnetic field. In FIG. 24, 73 and 74 are stepping motor driving pulses. The time intervals a and b for detecting an AC magnetic field are set before the time interval for applying the stepping motor driving pulses 73,74 and the time intervals a′,b′ for detecting magnetic fields comprising high frequency are set up just before the time intervals a and b for detecting AC magnetic field.

If either an AC magnetic field or magnetic field comprising high frequency is detected, the detection of the non-rotated condition of the rotor is inhibited and immediately motor driving pulses providing high stability against the magnetic field, for example, a pulse of 6 msec width as indicated in FIG. 10, is supplied.

Now, the detection system of a magnetic field will be described, followed by a description of the pulse width controlling system for the motor driving pulse supplied in response to the detection of the magnetic field.

FIG. 25 represents more detailed timing charts showing the operation for detecting magnetic fields, wherein the detection time intervals a and a′ of FIG. 24 are magnified and corresponding to the magnified timing chart, signal conditions at each terminal of the stepping motor driving circuit of FIG. 2 are illustrated. In FIG. 25, the numerals at the left side respectively correspond to the terminal numbers of FIG. 2. (H) and (L) at the right side of FIG. 5 represent logic levels HIGH and LOW respectively. P-channel output transistors 4*a* and 5*a* are in the OFF condition except when the stepping motor is driven. As a result, the output signal 101 is H during the time intervals a and a′. The detection transistors 7*a* and 7*b* for detecting the non-rotation condition of the rotor are in an ON condition only when the detection of non-rotation condition of the rotor is exercised. As a result, the signals at input terminals 105 and 106 are L. N-channel output terminals are normally in an ON condition except when the stepping motor is driven or when the detection of a magnetic field is carried out.

During the time interval a, and AC magnetic field is detected as follows; the included current is increased by chopping, that is, the switching ON and OFF of the N-channel output transistor 4*b* is repeated, that is, forming and breaking of the current loop 11 of FIG. 2 is repeated. Thus, the signals at terminal 103 becomes H and L, and the voltage induced at terminal 8*a* varys in potential. By comparing the induced voltage by using a comparator or a pair of inverters, the detection of AC magnetic field is accomplished.

During the time interval a′ for detecting a magnetic field comprising high frequency, which is very important in this invention, the circuit connected to the coil of the stepping motor has high impedance, as stated in the preceding explanation, so that the voltage induced across the coil of the stepping motor is directly detected. At that time N-channel output transistor 4*b* is in the OFF condition so that the signal at the terminal 103 is L level during the time interval a′. The preceding explanation describes one side of the coil terminals of the stepping motor, and in the other side also, the magnetic field can be detected by controlling the output transistor.

It is known from the preceding explanation that during the time interval a′, the peak values of the voltage induced under the influence of magnetic field comprising high frequency can be detected. The detection for magnetic field comprising high frequency calls for a detection period equal to or over 20 msec to obtain the peak value of the voltage produced under the influence of the magnetic field comprising high frequency, because the repeating frequency of the magnetic field comprising high frequency, which is generally produced from apparatus for personal use provided with a power supply from an AC source, is 60 Hz or 50 Hz. Here, mis-detection of the non-rotation condition of the motor, which is caused by the effect of the magnetic field comprising high frequency, can be avoided by setting the voltage level for detecting the magnetic field comprising high frequency by using a comparator or a pair of inverters lower than that for detecting a non-rotated condition of the rotor. Further, by providing the circuit having the following system, the detection of the non-rotated condition is inhibited in response to the detection of a magnetic field comprising high frequency, and immediately a stepping motor driving pulse of sufficient pulse width against the magnetic field comprising high frequency is supplied to the stepping motor.

It is proved from experiment by the inventors of this invention that magnetic field comprising high frequency does not need to have wider pulse width to drive the rotor than what is used in response to the detection of the AC magnetic field.

Figure 26:
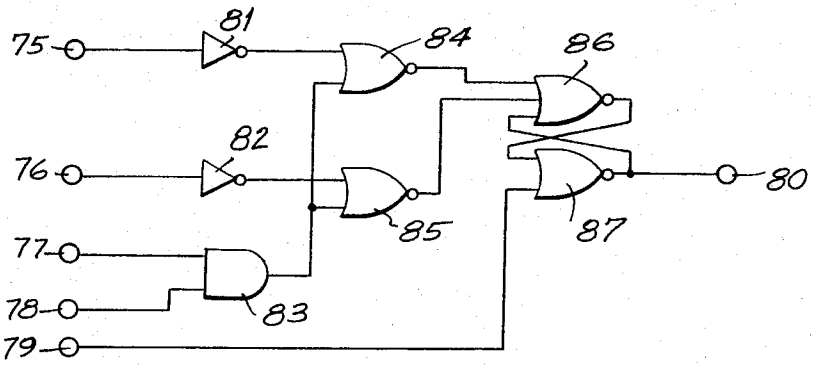
FIG. 26 is a circuit diagram of this invention which illustrates the operation of detections of magnetic fields comprising high frequency and AC magnetic fields using one pair of inverters.

One circuit embodiment of the detection inverter will now be described. Here, a pair of detection inverters or comparator used for the detection circuit for a possible AC magnetic field functions also in the detection circuit for magnetic field comprising high frequency. However, if another pair of detection inverters or comparators are used in the detection circuit for magnetic field comprising high frequency, stricter detection is achieved. FIG. 26 is a circuit diagram (Similar to FIG. 17) of the detection circuit of FIG. 21, which shows a circuit performing both the detection of AC magnetic field and also magnetic field comprising high frequency by using one pair of detection inverters. Detection inverters 81 and 82 are respectively connected to terminals 8*a* and 8*b*. NOR-gates 84–85 mask detection signals. NOR-gates 86, 87 form a latch circuit. Terminals 75, 76 are respectively connected to terminals 8*a* and 8*b*, to which the detection voltage is input. Terminal 77 is connected to the detection pulse generating circuit 63 for AC magnetic field as shown in FIG. 21, to which masking signals, being LOW only during the time interval for detecting AC magnetic field, are inputted. Terminal 77 is connected to the detection pulse generating circuit 62 for magnetic field comprising high frequency as shown in FIG. 21, to which masking signals, being LOW only during the time interval for detecting magnetic field comprising high frequency, are inputted. AND gate 83 synthesizes the above mentioned two type of masking signals. Terminal 79 is connected to the detection controlling circuit 61 of FIG. 17, to which resetting signals for the detection latch are input. Terminal 80 is connected to the detection controlling circuit 61 of FIG. 21, from which detection signals are applied. As stated above, this detection determining signal operates to inhibit the detection of a non-rotation condition of the rotor and to apply motor driving pulses of sufficient pulse width against the magnetic field.

Figure 27:
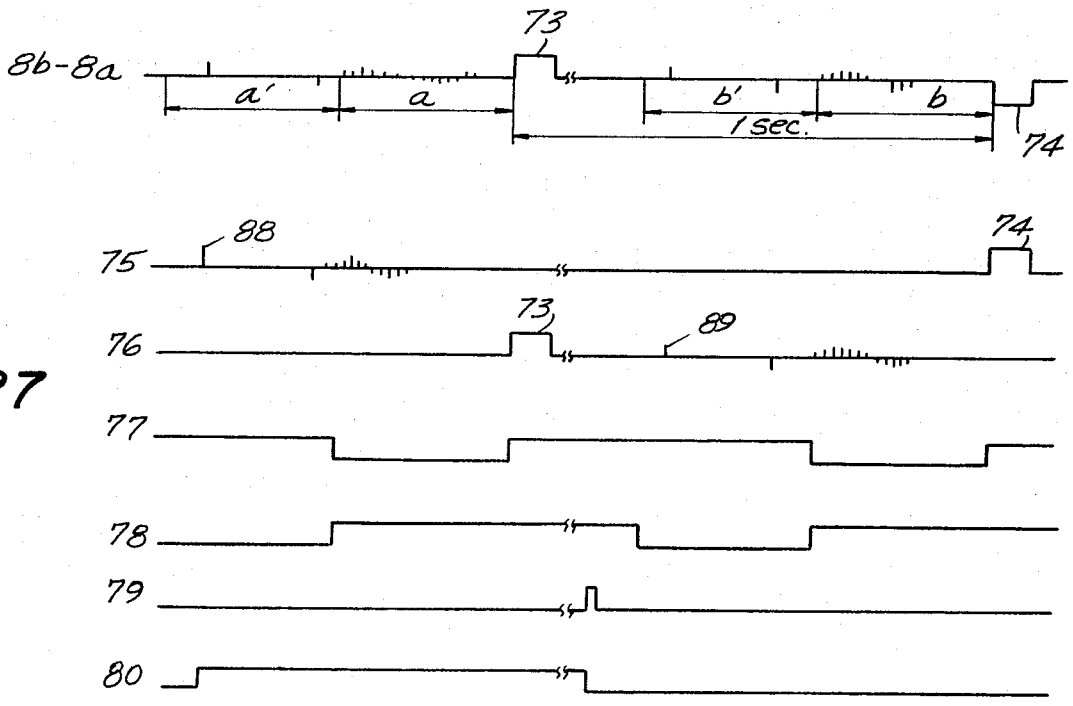
FIG. 27 is timing charts, which represent the signal condition at each terminal of FIG. 22.

FIG. 27 is a timing chart representing the signal condition at each terminal shown in FIG. 26. The uppermost timing chart of FIG. 27 is the same as that of FIG. 24, to which the other timing charts correspond. At terminal 75, which is connected to terminal 8*b*, the voltage produced across the coil of a stepping motor appears. The induced voltage 88 of FIG. 27 is detected by using the pair of detection inverters 81, in response to which, the output at terminal 80 becomes H as shown in FIG. 27. Then motor driving pulse 73 of enough pulse width for providing stability against the magnetic field is supplied. After the application of motor driving pulse 73, the signal at terminal 80 is reset and made L by a latch resetting signal from terminal 79. After that, the detection of magnetic field is not carried out, thus output at terminal 80 remains L as long as voltage 89 is lower than the threshold voltage of the detection inverter 82. Then, stepping motor driving pulse 74 of normal driving pulse width is applied, followed by operation of detection of whether or not the rotor is in a rotated condition.

The above described is an embodiment of this invention directed to the operation of detecting the magnetic field comprising high frequency. Now will be described how to control the driving of a stepping motor, carried out in response to the detection of a magnetic field.

Figure 28:
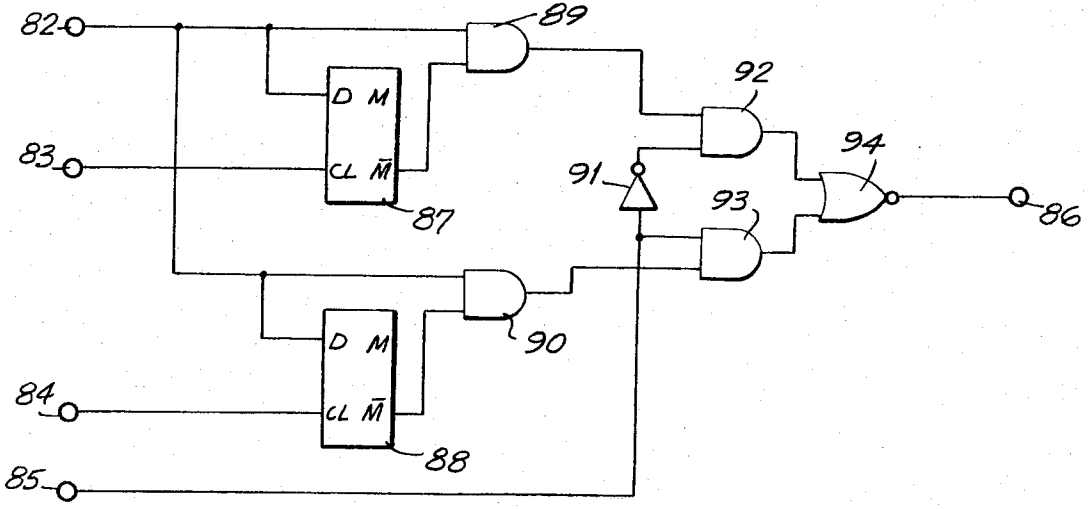
FIG. 28 is a circuit diagram of a pulse generating circuit which produces normal driving pulses and driving pulses of enough width for producing stability against a magnetic field.

FIG. 28 is a diagram of a circuit, which is a part of the pulse generating circuit 57 for driving the motor shown in FIG. 21, for generating normal driving pulses and also motor driving pulses providing stability against the magnetic field. Terminal 82 is connected to a frequency divider circuit, to which a hand-driving frequency signal is inputted. Terminal 83 is connected to a circuit, including an up/down (U/D) counter which operates to determine the pulse width, to which a signal for determining the normal pulse width is input. To terminal 84, an input signal is supplied for determining the driving pulse width so as to provide stability against magnetic field. Terminal 85 is connected to terminal 80 as shown in FIG. 26 to which a signal for changing the normal driving pulse is inputted. Terminal 86 is connected to a stepping motor driving circuit 58 as shown in FIG. 21, from which signals for controlling the output transistor which drives the stepping motor are supplied.

Latch circuit 87, through which data is passed when the clock is H, and data is held when the clock is L, operates to delay the signal at terminal 83 for normal driving pulse width. Latch circuit 88 carrys out a similar operation to the latch circuit 87, that is, delays the signal at terminal 84 for driving pulse width under the influence of a magnetic field. AND circuit 89 produces the normal driving pulse. AND circuit 90 produces a driving pulse of such a wide pulse width as to provide stability against the magnetic field. A pulse width determining circuit consists of NOT circuit 91, AND circuits 92 and 93 and NOR circuit 94. Normal driving pulses are supplied from terminal 86 when a signal at terminal 85 is L and drivng pulses of said a wide width as to provide stability against the magnetic field are supplied from terminal 86 when the signal at terminal 85 is H.

Figure 29:
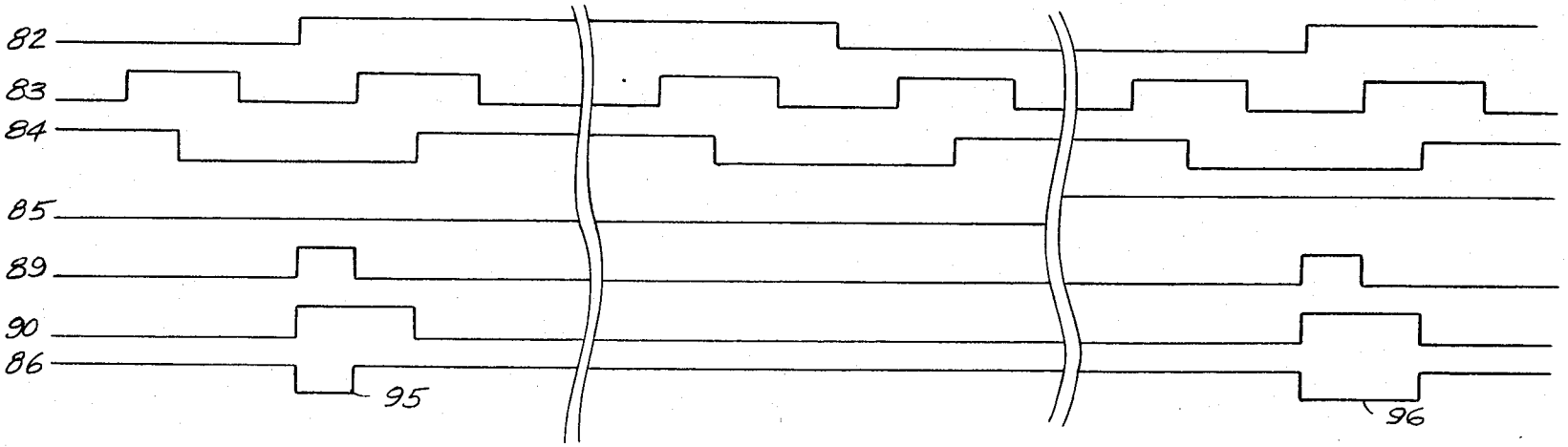
FIG. 29 is timing charts, which represent the operation of the circuit shown in FIG. 28.

FIG. 29 is timing charts which represent the operation of the circuit shown in FIG. 28. The figures described at the left side of FIG. 29 signify the terminal numbers or output circuit numbers of FIG. 28. In FIG. 29 is a normal driving pulse 95, and 96 of FIG. 29 is a driving pulse providing sufficient stability against a magnetic field, which results from the fact that the signal from AND circuit 89 is selected when the signal at terminal 85 is H and the signal from AND circuit 90 is selected when the signal at terminal 85 is L as shown in the bottom timing chart of FIG. 29.

In summary, this invention provides a time interval for detecting AC magnetic field just before a time interval for driving a stepping motor. Further, a time interval is provided for detecting magnetic field comprising high frequency just before the time interval for detecting AC magnetic field. It is intended that both of the detections of AC magnetic field and magnetic field comprising high frequency are carried out immediately before the stepping motor driving period, whereby reliability of stepping motor driving is improved. That is, the detection time interval for an AC magnetic field is provided just before a stepping motor driving period because during the detection time interval for AC magnetic field, detection of an external disturbance is also intended to be carried out in addition to the detection of AC magnetic field by using the current induced by the oscillation movement of the rotor caused by an external magnetic disturbance.

With respect to the detection of the magnetic field comprising high frequency, which is to detect the state of circumstances around the electronic timepiece, it is not necessarily required to carry out the detection of the magnetic field comprising high frequency immediately before the driving time interval of a stepping motor. However, it is desirable not to set up the detection time interval for magnetic field comprising high frequency too far apart from the stepping motor driving period. Therefore in this invention, the detection of magnetic field comprising high frequency is carried out just before the detection of AC magnetic field.

The function of the detecting circuit of this invention does not change even though N-channel transistor and P-channel transistor thereof are interchanged. In such a case each terminal is reversed (HIGH to LOW, LOW to HIGH). In the embodiment of this invention, the driving pulses of the same pulse width are fed to the motor in response to the detection of high frequency magnetic field and to the detection of sinusoidal AC magnetic field. However, the stepping motor can be actually driven with a narrower pulse in response to the detection of magnetic field comprising high frequency than in response to the detection of AC magnetic field. Accordingly further economy in power consumption is achieved if the motor is supplied with a narrower driving pulse in response to detection of magnetic field comprising high frequency than in response to detection of AC magnetic field.

In the above mentioned system, it is appropriate to select the driving pulse, which is supplied to the motor in response to the detection of magnetic field comprising high frequency, from the range of pulse widths described with the aid of FIG. 8 with the view to simplify the detector and driver circuit. Especially the driving pulse a3 of FIG. 8, which has the longest pulse width or the driving pulse a2 of FIG. 8, which has one step shorter pulse width than a3, is most appropriate because magnetic field comprising high frequency with square wave does not have so much energy as to exercise a great influence on the driving of the motor in comparison with a sinusoidal AC magnetic field. That is, reliability of the driving of the time display of the timepiece is secured without the supply of so long a pulse width as 6 msec, as described above with the aid of FIG. 10 as most stable against AC magnetic field. Accordingly power consumption of the stepping motor under the influence of a magnetic field comprising high frequency is reduced, then further economy of overall power consumption is achieved.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An electric analog timepiece including:

oscillator means having a high frequency standard signal as an output;

divider means having said high frequency standard signal as an input and having a timekeeping signal of lower frequency as an output;

pulse generating means having the timekeeping signal as an input and selectively providing, as an output, driving pulses having a first width and driving pulses having a second width, the second width being greater than the first width;

an electric stepping motor having a rotor, a stator, and a coil, said rotor being driven in rotation by the application of one of said driving pulses to said coil;

means for detecting non-rotation of said rotor in response to said driving pulse;

means for detecting comparatively low frequency external magnetic fields;

means for detecting comparatively high frequency external magnetic fields; and control means responsive to at least one of the detection of non-rotation of said rotor, the detection of a comparatively low-frequency external magnetic field, and the detection of a comparatively high-frequency external magnetic field to cause said pulse generating means to drive said stepping motor with at least one driving pulse of greater width.

2. An electric analog timepiece as claimed in claim 1 in which said means for detecting comparatably high frequency external magnetic fields further comprises:

means for connecting said motor coil in open circuit during a period between driving pulses; and means for sensing the voltage induced in said coil by the presence of a comparatively high frequency external magnetic field.

3. An electric analog timepiece as claimed in claim 2 wherein said means for detecting comparatively low frequencies further comprises:

means for connecting said coil in a low resistance circuit during another period between driving pulses; and means for sensing the voltage induced in said coil by the presence of a comparatively low frequency external magnetic field.

4. An electric analog timepiece as claimed in claim 3 and further comprising:

means for amplifying the voltage induced in said coil by the presence of a comparatively low magnetic field, comprising means for switching said coil between said low resistance circuit and a circuit of higher resistance, whereby the inductive reactance of said coil tends to maintain the level of the current flowing in said coil at the time of switching so that a higher voltage appears across said coil.

5. An electric analog timepiece as claimed in claim 3 wherein said means for sensing further comprises:

comparison circuit means providing an output when the voltage induced in said coil exceeds a predetermined threshold level, said comparison means having an output which is fed to said control means for selecting said pulse of greater width.

6. An electric analog timepiece as claimed in claim 5 wherein said comparison circuit means comprises a pair of inverters having an output which is fed to said control means.

7. An electric analog timepiece as claimed in claim 1, wherein said pulse generating means further provides a control signal for activating said means for detecting comparatively low frequency external magnetic field before the application of a driving pulse to said coil and another control signal for activating said means for detecting comparatively high frequency external magnetic fields before the activation of said means for detecting comparatively low frequency external magnetic fields.

8. An electric analog timepiece as claimed in claim 1, wherein operation of said means for detecting non-rotation of said rotor is disabled following the application of one of said driving pulses of greater width to said coil.

9. An electric analog timepiece as claimed in claim 8, wherein said pulse generating means further provides a control signal for activating said means for detecting comparatively low frequency external magnetic fields before the application of a driving pulse to said coil and another control signal for activating said means for detecting comparatively high frequency external magnetic fields before the activation of said means for detecting comparatively low frequency external magnetic fields.

10. An electric analog timepiece as claimed in claim 1 wherein the pulse generating means further provides driving pulses having a third width, the third width being greater than the first width and less than the second width, and in which the detection of a comparatively low frequency external magnetic field causes said stepping motor to be driven by a driving pulse having the second width and the detection of a comparatively high frequency magnetic field causes the the stepping motor to be driven by a driving pulse having the third width.

11. An electric analog timepiece as claimed in claim 8 wherein said means for sensing further comprises:

comparison means to which a voltage to be sensed is fed, said comparison means providing an output to said control means to cause the output of a driving pulse of greater width when the sensed voltage exceeds a predetermined threshold level.

12. An electric analog timepiece as claimed in claim 4, wherein said period for detecting a low frequency magnetic field occurs before the application of a driving pulse to said coil, and said period for detecting an external magnetic field of high frequency occurs before said period for detecting an external magnetic field of comparatively low frequency.

* * * * *